US007706731B2

(12) United States Patent
Martin et al.

(10) Patent No.: US 7,706,731 B2
(45) Date of Patent: Apr. 27, 2010

(54) HYBRID PRINTING SYSTEM

(75) Inventors: Michael John Martin, Hamlin, NY (US); James J Spence, Honeoye Falls, NY (US); Richard A Lux, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 360 days.

(21) Appl. No.: 11/778,281

(22) Filed: Jul. 16, 2007

(65) Prior Publication Data

US 2009/0022525 A1 Jan. 22, 2009

(51) Int. Cl.
*G03G 15/01* (2006.01)

(52) U.S. Cl. ..... 399/298; 399/299; 399/302

(58) Field of Classification Search ..... 399/297, 399/298, 299, 302, 312, 313
See application file for complete search history.

(56) References Cited

U.S. PATENT DOCUMENTS 3,935,424 A 1/1976 Donnelly et al.
4,427,285 A 1/1984 Stange
5,260,725 A 11/1993 Hammond
5,274,428 A 12/1993 Wong et al.
5,347,353 A 9/1994 Fletcher
5,613,176 A 3/1997 Grace
5,807,652 A 9/1998 Kovacs
5,837,408 A 11/1998 Parker et al.
5,848,345 A 12/1998 Stemmle
6,163,672 A 12/2000 Parker et al.
6,853,829 B2 * 2/2005 Hoshi et al. ..... 399/299

* cited by examiner

*Primary Examiner*—Hoang Ngo
(74) *Attorney, Agent, or Firm*—Fay Sharpe LLP

(57) ABSTRACT

A hybrid printing system including (a) a machine frame; (b) a multi-color image producing module mounted within the machine frame and including color image output terminals and an endless intermediate transfer member for receiving color images from the color image output terminals to form a multi-color image; (c) a separate black image producing module mounted within the machine frame spaced from the multi-color image producing module and including a black image output terminal; and (d) a print media transport/transfer module mounted within the machine frame for receiving and moving image receiving print media through the machine frame, the print media transport/transfer module including a repositionable electrostatic transport/transfer member having multi-positions including (i) a first position forming a first image transfer nip with the endless intermediate transfer member, and (ii) a second position forming a second image transfer nip with the black image output terminal.

18 Claims, 6 Drawing Sheets

HYBRID PRINTING SYSTEM

The present disclosure relates to electrostatographic image producing machines and, more particularly to a single-pass hybrid color and black printing system for producing multi-color images as well as black images.

Generally, electrostatographic copying is performed in cycles by exposing an image of an original document onto a substantially uniformly charged photoreceptive member. The photoreceptive member has a photoconductive layer. Exposing the charged photoreceptive member with the image discharges areas of the photoconductive layer corresponding to non-image areas of the original document, while maintaining the charge in the image areas. In discharge area development, the reverse is true where the image areas are the discharged areas and the non-image areas are the charged areas. Thus in either case, a latent electrostatic image of the original document is created on the photoconductive layer of the photoreceptive member.

Charged developing material is subsequently deposited on the photoreceptive member to develop the latent electrostatic image areas. The developing material may be a liquid material or a powder material. The charged developing material is attracted to the charged image areas on the photoconductive layer. This attraction develops the latent electrostatic image into a visible toner image. The visible toner image is then transferred from the photoreceptive member, either directly or after an intermediate transfer step, to a copy sheet or other support substrate as an unfused toner image which is then heated and permanently affixed to the copy sheet, resulting in a reproduction or copy of the original document. In a final step, the photoconductive surface of the photoreceptive member is cleaned to remove any residual developing material in order to prepare it for successive imaging cycles.

In multi-color electrostatographic printing, rather than forming a single latent image on the photoconductive surface, successive latent images, corresponding to different color separations, must be created. Each single color latent electrostatic image is developed with a corresponding colored toner. This process is repeated for a plurality of cycles. By anyone of several processes, each single-color toner image is eventually superimposed over the other and then results in a single multi-color toner image on the copy sheet. Thereafter, the multi-color toner image is also heated and then permanently fixed to a copy sheet, creating a full-color print.

In a conventional tandem color printing process, four imaging systems are typically used. Photoconductive drum imaging systems are typically employed in tandem color printing due to the compactness of the drums. Although drums are used in the preferred embodiments, a tandem system can alternatively use four photoconductive imaging belts instead of the drums. Each imaging drum or belt system charges the photoconductive surface thereof, forms a latent image on the thereon, develops it as a toned image and then transfers the toned image to an intermediate belt or to a print media. In this way, yellow, magenta, cyan, and black single-color toner images are separately formed and transferred. When superimposed, these four toned images can then be fused, and are capable of resulting in a wide variety of colors.

In single pass image-on-image color printing, an endless photoreceptor belt, a controller and a series of imaging subassemblies are employed that each include a charging unit, a color separation latent image exposure ROS unit or LED print bar, and a corresponding color toner development unit. As the endless photoreceptor belt moves in an indicated direction, an image frame thereon is charged, exposed and developed, in succession, by each imaging subassembly, with each imaging subassembly thus forming a color separation image corresponding to color separation image input video data from the controller. After the first imaging subassembly forms its color separation toner image, that color separation toner image is then recharged and re-exposed to form a different color separation latent image, and then correspondingly developed by the next imaging subassembly. After the final color separation image is thus formed, the fully developed multi-color image is then ready to be transferred from the image frame at a transfer station to a print media.

Following is a discussion of prior art, incorporated herein by reference, which may bear on the patentability of the present disclosure. In addition to possibly having some relevance to the question of patentability, these references, together with the detailed description to follow, are intended to provide a better understanding and appreciation of the present disclosure.

U.S. Pat. No. 5,347,353 issued Sep. 13, 1994 to Fletcher and entitled "Tandem high productivity color architecture using a photoconductive intermediate belt" discloses a system in which tandem, high productivity color images are formed by using a photoconductive belt as an imaging surface and as a transferring device. A multi-colored image is produced comprising a plurality of color layers. The apparatus includes a charging device, an image forming device, and a developing device located along a photoconductive belt to form a toned image layer on the belt. Additional color layers may be provided by either photoreceptive imaging drums or additional photoconductive belts.

U.S. Pat. No. 6,163,672 issued Dec. 19, 2000 to Parker et al. and entitled "Tandem tri-level xerographic apparatus and method for producing highly registered pictorial color images" discloses apparatus and method for creating highly registered quality pictorial color images include a first tri-level xerographic module using first and second color marking materials for creating and developing a first tri-level image including custom CAD and custom DAD image areas having different voltage levels respectively to form a first composite color separation image; a transfer station for transferring the first composite color separation image onto an intermediate transfer member; a second tri-level xerographic module using third and fourth color marking materials for similarly creating and developing a second tri-level image including custom CAD and custom DAD image areas having different voltage levels respectively to form a second composite color image; a transfer station for transferring the second composite color separation image, in registration onto the intermediate transfer member; a third tri-level xerographic module using fifth and sixth color marking materials for similarly creating and developing a third tri-level image including custom CAD image areas and custom DAD image areas having different voltage levels respectively to form a third composite color image; wherein pairings of the first and second, third and fourth, and fifth and sixth, color marking materials are selected so that one such pairing is cyan (C) and magenta (M) so as to improve registration of the desired final pictorial image.

U.S. Pat. No. 5,837,408 issued Nov. 17, 1998 to Parker et al. and entitled "Xerocolography tandem architectures for high speed color printing" discloses a full process color imaging system that uses two xerocolography engines in tandem. Each of the two xerocolography engines is capable of creating three perfectly registered latent images with subsequent development thereof in a spot next to spot manner. Each engine is provided with three developer housing structures containing five different color toners including the three subtractive primary colors of yellow, cyan and magenta. Two of the primary colors plus black are used with one of the engines. The third primary color is used with the second tandem engine which also uses one of the primary colors used with the first engine as well as a fifth color which may be a logo or a gamut extending color. The full process color imaging capability provided is effected without any constraints regarding the capability of the laser imaging device to image through previously developed components of a composite image. Also, the development and cleaning field impracticalities imposed by quad and higher level imaging of the prior art are avoided. Moreover, the number of required image registrations compared to conventional tandem color imaging is minimal. Therefore, only one registration is required compared to three or four by conventional tandem engine imaging systems.

U.S. Pat. No. 5,807,652 issued Sep. 15, 1998 to Kovacs and entitled "Process for producing process color in a single pass with three wavelength imager and three layer photoreceptor" discloses a process for producing eight distinct colors, (viz. K, C, M, Y, CM, CY, MY and W) in a single pass with a single exposure in a 3.lambda./3L imaging system is provided. The use of xerocolography with a fifth developer housing containing the same color toner as one of the four normally used developer housings and suitable flood exposure devices overcomes the limitations of prior art K+6 imaging systems which utilize an exposure device capable of emitting light beams at three different wavelengths and a photoreceptor having three layers responsive to the three wavelengths.

U.S. Pat. No. 5,274,428 issued Dec. 28, 1993 to Wong et al. and entitled "Single pass direct transfer color printer" discloses a high throughput, single pass direct transfer color printer utilizing a roll web based design which simplifies tandem engine architecture by eliminating a very difficult subsystem. Improved image registration is achieved simply by position/velocity synchronization of the paper web with respect to photoreceptors of the tandem print engines. Frictional slip between the web and an overrunning vacuum transport/transfer develops web tension which in turn provides a positive contact between the web and the photoreceptors needed for good image transfer. An arcuate, convex paper path increases normal forces applied to the engines which increases contact pressure, as well as increasing contact surface area of the engines and the web. A web buckle between the vacuum transport/transfer and a fuser is provided to reduce vibrational disturbances and a cutter furnishes a printout in an appropriate size.

U.S. Pat. No. 5,613,176 issued Mar. 18, 1997 to Grace and entitled "Image on image process color with two black development steps" discloses a printing system using a recharge, expose and development image on image process color system in which there is an optional extra black development step. The printing system may be a single pass system where all of the colors are developed in a single pass or a multi-pass system where each color is developed in a separate pass. The additional black development step results in optimal color quality with black toner being developed in a first and/or last sequence. Having more than one black development station allows low gloss and high gloss black toner to be applied to the same image, enabling the very desirable combination of low gloss text and high gloss pictorials on the same page.

U.S. Pat. No. 5,260,725 issued Nov. 9, 1993 to Hammond and entitled "Method and apparatus for registration of sequential images in a single pass, color xerographic printer" discloses a single pass, hybrid ROS/print bar system provides a plurality of latent images which may subsequently be developed in different colors. A ROS unit is initially aligned so that each scan line is registered in the process direction. The alignment is accomplished by forming a pair of opposed V-shaped apertures in the surface of the belt and detecting scan line cross-over of the legs of the V. These cross-overs are manifested as two sets of pulses generated by sensors associated with each target leg. The time differences between pulse sets are compared and the scan line is rotated until the time differences are equal. Once the ROS is registered for skew, one or more print bars are registered by enabling non-image pixels and comparing the output generated by detectors when the lit pixels are viewed through the V-shaped aperture.

U.S. Pat. No. 5,848,345 issued Dec. 8, 1998 to Stemmle and entitled "Two sided imaging of a continuous web substrate with moving fusers" discloses a continuous web substrate duplex (both sides) printing system which can utilize a single otherwise conventional or existing xerographic print engine (normally printing conventional cut sheet print substrates) without substantial structural modification, instead of requiring plural print engines on opposite sides of the web. This may be accomplished as shown by operatively docking a special duplex continuous web printing substrate supply module with the cut sheet print engine to form an integral duplex web printing system. Here, this duplex web printing module has an integrated fusing system with translating and half-surface-speed roll fusers for fusing the transferred images on both sides of the web with those two separate moving fusers, with each fuser fusing images on one side of the web after respective separate transfers of sequences of plural first and second web side images. One of these moving fusers is fusing the first side images in an expanding and contracting web loop section of the endless web in between first and second side image transfer stations.

U.S. Pat. No. 3,935,424 issued Jan. 27, 1976 to Donnelly et al. and entitled "Flash fusing apparatus" discloses a flash fusing apparatus for fusing toner images onto flexible support material in which the support material is transported in a cylindrical path encircling the flash fusing lamp which is positioned along longitudinal axis of the path. The cylindrical path is defined a cylindrical member encircling the flash fusing lamp. One or more disc members positioned along the cylindrical path are used to advance the support material along its path with the toner images facing inwardly toward the lamp to receive uniform radiation upon pulsing of the lamp which is activated by a sensing device.

U.S. Pat. No. 4,427,285 issued Jan. 24, 1984 to Stange and entitled "Direct duplex printing on pre-cut copy sheets" discloses a two photoreceptor, single pass duplex reproduction system that has a heat insulating prefuser transport/transfer device and first and second transfer stations. In particular, the prefuser transport/transfer is a pair of cold, toner compacting rolls adjacent the second transfer station for immediate pick up of a copy sheet supporting unfused images on both sides. The compacting rolls tack the unfused images to the copy sheet. The compacting rolls also insulate the photoreceptor from the heat of the fuser and convey the copy sheet immediately to the fuser. The fuser permanently fixes the images onto the copy sheet in one fuser operation. In a preferred embodiment, the fuser rolls operate at a slightly lower peripheral velocity than the compacting rolls. Also, because of the tacking of the image by the cold rolls, the fuser rolls operate at a relatively lower temperature or pressure than normally.

Conventional printing systems such as those described above can nowadays be found in the office environment as well as in small or entry production environments and in higher volume production environments. The trend by manufacturers however is towards slower color image producing versions that also offer a limited form of "black images" from the color version. However, the black image production is limited because color version printers (including the current conventional ones that also offer black images) tend to run at higher run costs per print even when running black images only or in a black mode. The undesirable result is additional wear to the color components as well as higher run costs for each print, color or black.

There is therefore a current need for a printing system that can produce color images as well as black images without the current disadvantages of slower speeds and higher costs for the black images.

In accordance with the present disclosure, there is provided a hybrid printing system including (a) a machine frame; (b) a multi-color image producing module mounted within the machine frame and including color image output terminals and an endless intermediate transfer member for receiving color images from the color image output terminals to form a multi-color image; (c) a separate black image producing module mounted within the machine frame spaced from the multi-color image producing module and including a black image output terminal; and (d) a print media transport/transfer module mounted within the machine frame for receiving and moving image receiving print media through the machine frame, the print media transport/transfer module including a repositionable electrostatic transport/transfer member having multi-positions including (i) a first position forming a first image transfer nip with the endless intermediate transfer member, and (ii) a second position forming a second image transfer nip with the black image output terminal.

Reference may be had to the accompanying drawings, which include:

Figure 3:
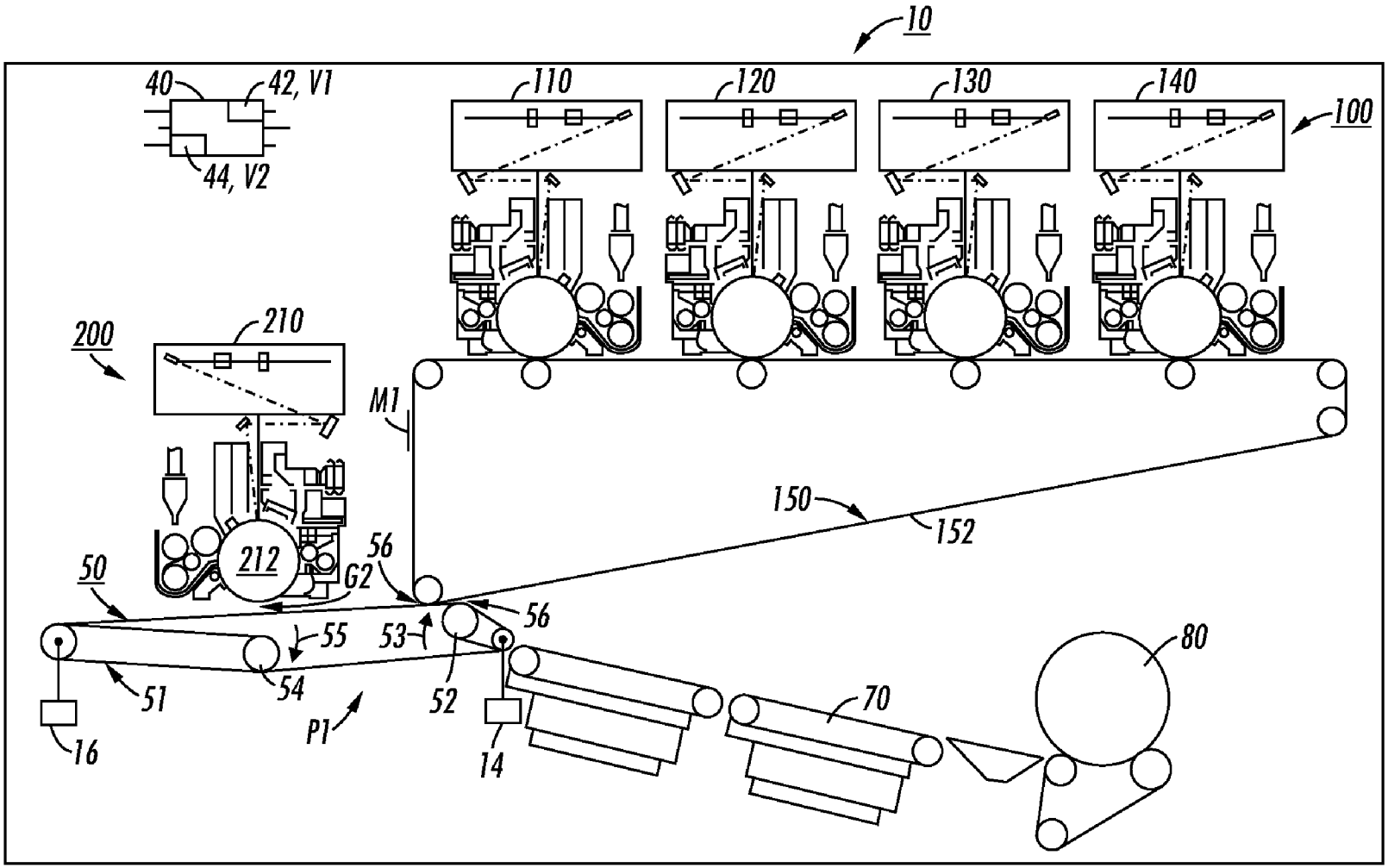
FIG. 3 is an enlarged schematic of the first embodiment of FIG. 1 in a multi-color image producing mode.
Figure 5:
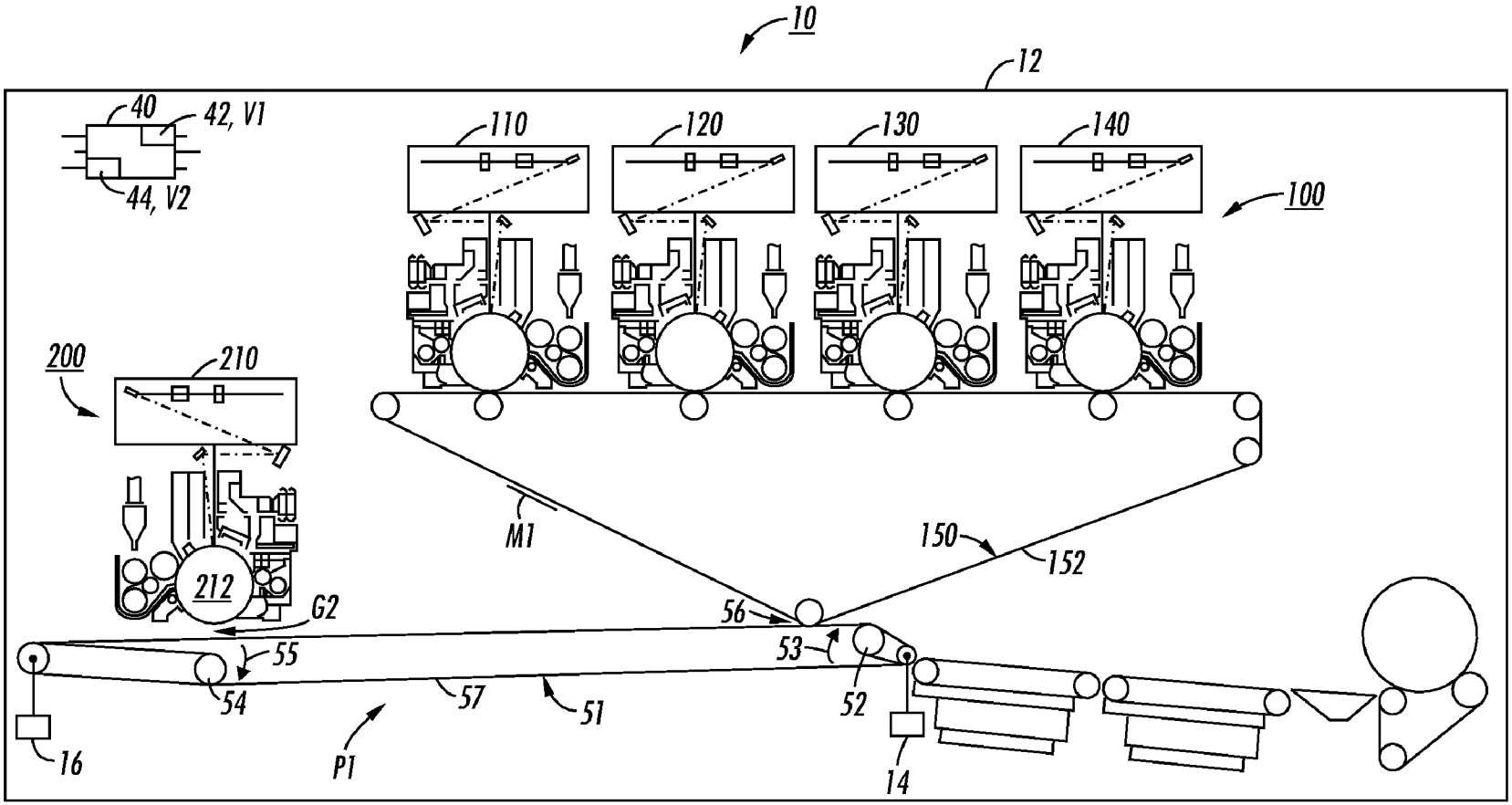
Figure 6:
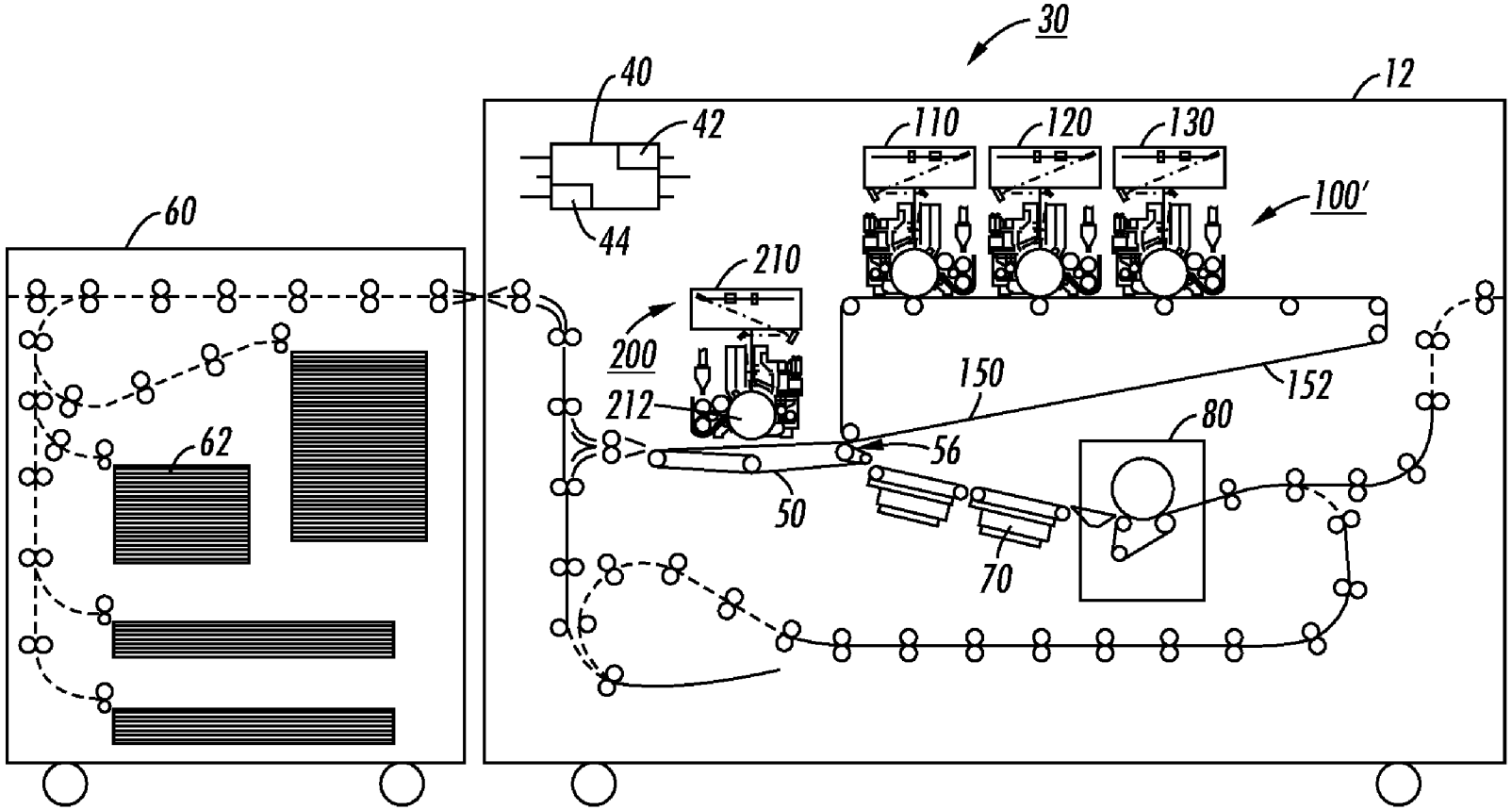

FIG. 5 is a schematic elevational view of a different configuration of the multi-color image producing first embodiment of FIG. 3 including a relatively longer transport module; and FIG. 6 is a schematic elevational view of a second embodiment of the hybrid printing system of the present disclosure showing a multi-color image producing module having only Cyan, Yellow and Magenta image output terminals.

Figure 1:
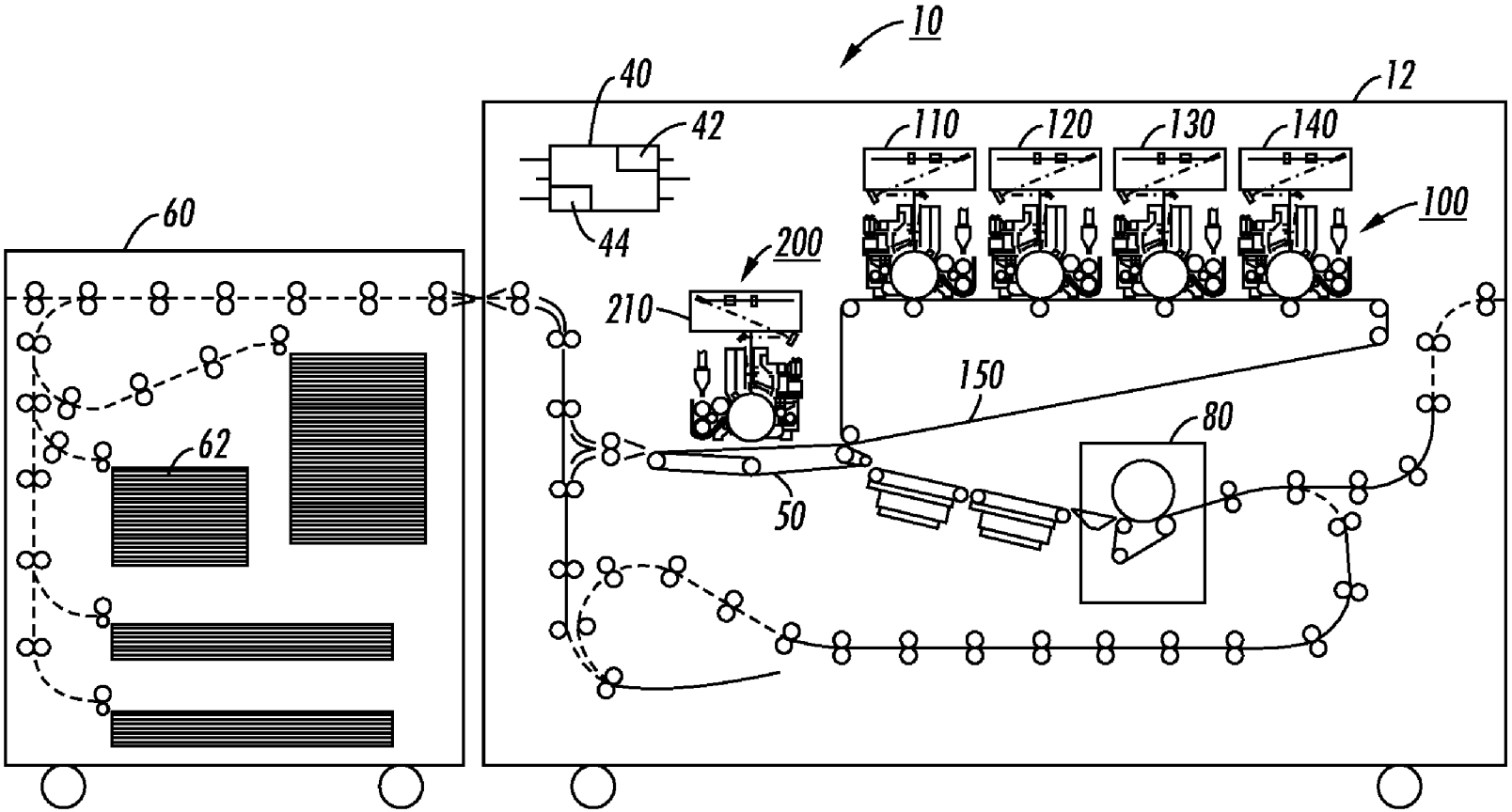
FIG. 1 is a schematic elevational view of a first embodiment of the hybrid printing system of the present disclosure showing a multi-color image producing module having an included black image output terminal.
Figure 2:
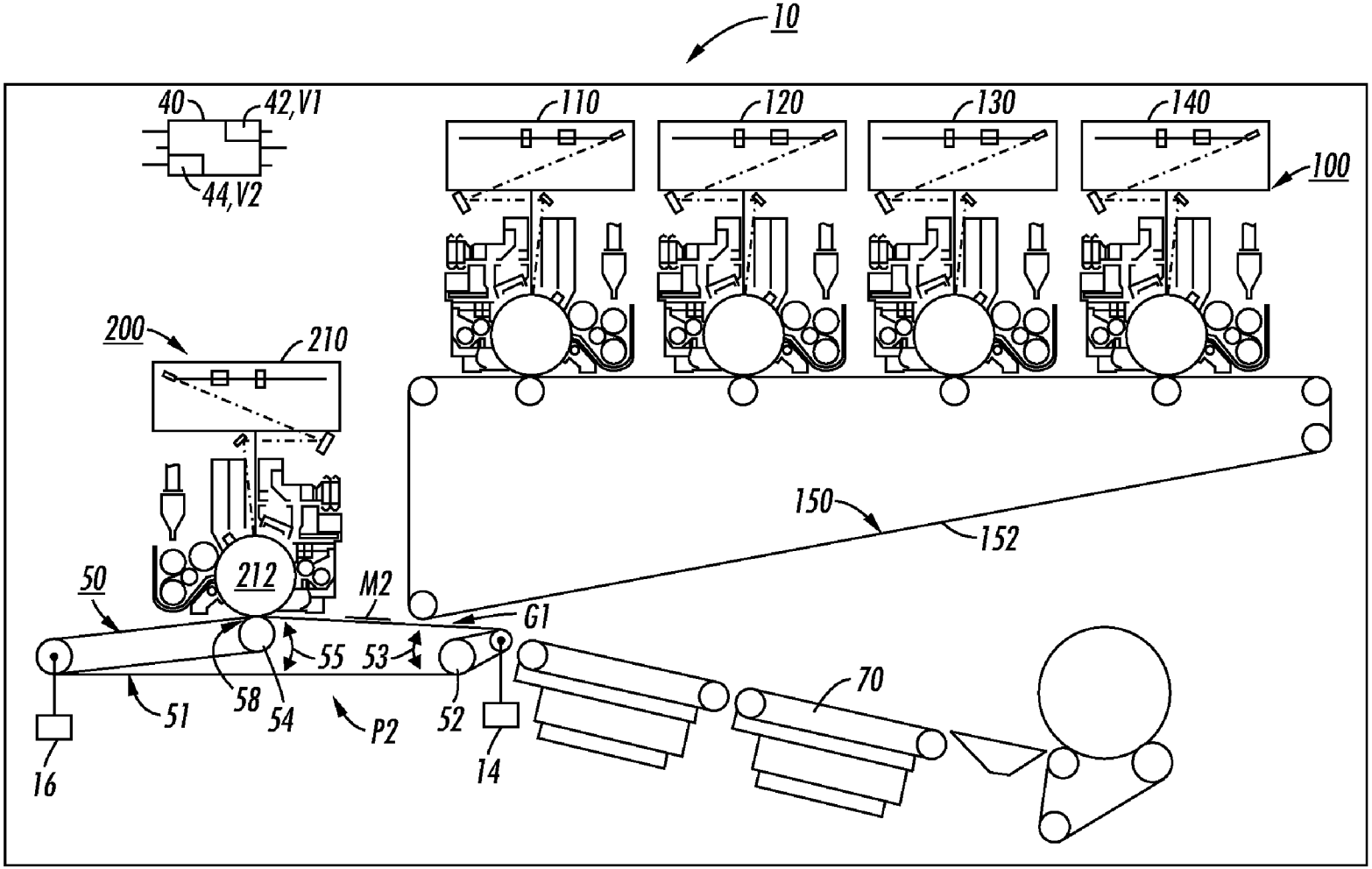
FIG. 2 is an enlarged schematic of the first embodiment of FIG. 1 in a black image producing mode.
Figure 4:
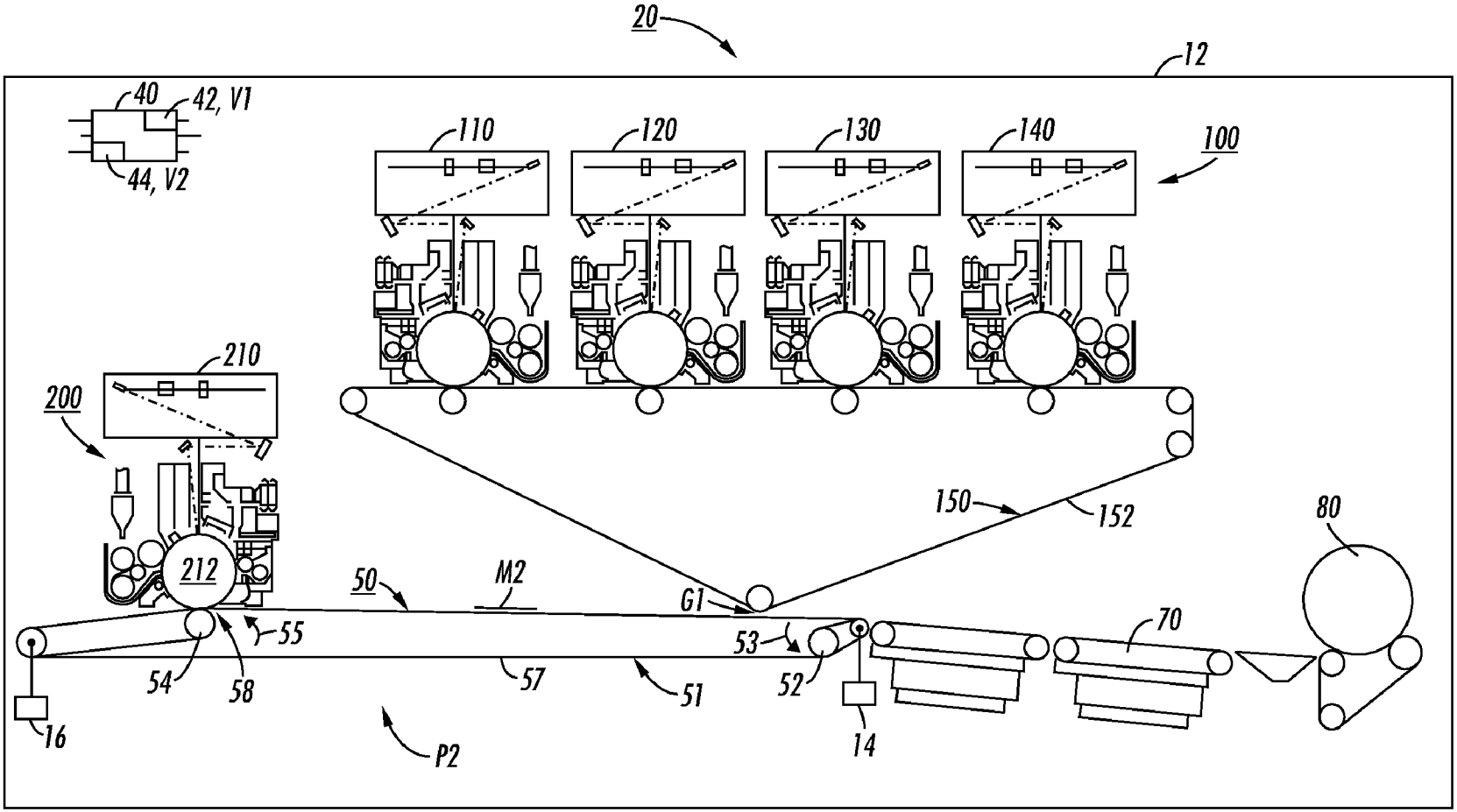
FIG. 4 is a schematic elevational view of a different configuration of the black image producing first embodiment of FIG. 2 including a relatively longer transport module.

Referring first to FIGS. 1-5, different configurations of a first embodiment of the hybrid printing system 10, 20, 30 (FIGS. 1-3, 4-5 and 6 respectively) of the present disclosure are illustrated. As shown, the first embodiment 10, 20 (FIGS. 1-5) includes a selectable full color print engine 100 (or multi-color image producing module) that has an included black image output terminal 110. The first embodiment 10 also includes a separate selectable black print engine 200 or black image producing module. For the multi-color image producing module 100 and the black image producing module 200, the hybrid printing system 10, 20, 30 includes a controller 40 and a single common, repositionable electrostatic belt transport/transfer module 50 for enabling from the same system, selectable alternative full process color printing as shown in FIGS. 3 and 5, and near stand-alone black printing as shown in FIGS. 2 and 4.

The repositionable electrostatic belt transport/transfer module 50 and the controller 40 function to enable the black print engine or black image producing module 200 to be selectably bypassed while the hybrid printing system 10, 20, 30, is running in the full color engine mode (FIGS. 3 and 5). The repositionable electrostatic belt transport/transfer module 50 and controller 40 also function to enable the full color print engine or multi-color image producing module 100 to be selectably bypassed while the hybrid printing system 10, 20, 30 is running in the black engine mode (FIGS. 2 and 4). As illustrated, this selectable bypass capability isolates and inactivates either the color or the black module components (to be described below) such that they do not suffer additional wear and tear when they are not being used to make customer prints.

More specifically as illustrated in FIGS. 1-6, the hybrid printing system 10, 20, 30 of the present disclosure for example is comprised of a drum based xerographic black print engine or black image producing module 200 that includes a stand alone drum-based black image output terminal 210 and that can be operated as a stand-alone monochrome black print engine (FIGS. 2 and 4). The first embodiment of the hybrid printing system 10, 20 (FIGS. 1-5) also includes a drum-based and intermediate transfer belt-based CMYK full color print engine or multi-color image producing module 100 that features drum-based CYM image output terminals 120, 130, 140, the included K (black) image output terminal 110, and an intermediate transfer belt 150 on which the image output terminals 110, 120, 130, 140 form a multi-color image M1. As illustrated in FIG. 1, but true of all the FIGS. 1-6, the hybrid printing system 10, 20, 30 includes a media holding and supply module 60 that is coupled to the print media transport/transfer module 50, and includes and supplies cut sheet media 62 for example.

Specifically too, the hybrid printing system 10, 20, 30 further includes the unique electrostatic transport/transfer module 50 that is located between the color and black print engines or modules 100, 100', 200 as shown. The electrostatic transport/transfer module 50 as shown in FIGS. 2-5, has a pair of bias/backup rolls 52, 54 that are positioned at image transfer points P1, P2 for images formed by the print engines or modules 100, 100', 200. As shown, these bias rolls 52, 54 are selectably positionable and retractable as shown by arrows 53, 55 for supporting (i) a full color print engine only mode (FIGS. 3 and 5), or a (ii) a black print engine only mode (FIGS. 2 and 4).

In the full color print engine only mode (FIGS. 3 and 5), (a) the black image producing module 200 is inactivated and the image output terminals 110, 120, 130, 140 of the multi-color image producing module 100 are operated to form a full CYMK color image M1 on the intermediate transfer belt 150 in a conventional manner; (b) the first bias roll 52 of the electrostatic transport/transfer module 50 under the multi-color image producing module 100 is cammed 53 into an active or run position for creating the first transfer nip 56 that is required to enable image transfer from the multi-color image producing module 100; and (c) the second bias roll 54 under the black print engine or black image producing module 200 is cammed 55 down and away from the black image output terminal's photoreceptor drum 212, thus creating a free space or gap G2 between the electrostatic transport/transfer module 50 and the photoreceptor drum 212.

In this full color print engine only mode configuration, the black print engine 200 is completely inactive and the electrostatic transport/transfer module 50 carries print media 62 passed the inactive black print engine 200 (without contacting the black photoreceptor drum 212), into the first or color module image transfer nip 56 for receiving the full CYMK color image M1 during image transfer. Thereafter, the electrostatic transport/transfer module 50 carries the print media 62 (bearing the transferred full CYMK color image M1) through to the pre-fuser module 70. The multi-color image M1 can thereafter be fused through the fusing module 80 as shown.

In the (ii) black engine only mode, (a) the multi-color image producing module 100 is inactivated and the black image output terminal 210 of the black print engine 200 is operated in a monochrome fashion to produce a black image M2 on the photoreceptor drum 212 at near monochrome rates (speed and cost); (b) the first bias roll 52 under the multi-color image producing module 100 is cammed 53 down and away from the intermediate transfer belt 150 thus creating a different free space or gap G1 between the electrostatic transport/transfer module 50 and the intermediate transfer belt 150; and (c) the second bias roll 54 under the black print engine 200 is cammed 55 into an active or run position for creating the second transfer nip 58 that is required to enable image transfer from the photoreceptor drum 212 during black print engine only printing (FIGS. 2 and 4).

In this black engine only mode configuration, only the black print engine 200 is active and the electrostatic transport/transfer module 50 carries the print media 62 from the black print engine transfer nip 58 (where it receives the black only image M2) during image transfer, passed the color intermediate transfer belt 150 (without contacting it). Thereafter, the electrostatic transport/transfer module 50 carries the print media 62 (bearing the transferred black only image M2) through to the pre-fuser module 70. The black image M2 can thereafter be fused through the fusing module 80 as shown. While the hybrid printing system 10, 20 is in the black print engine only mode (FIGS. 2 and 4), as mentioned above, the full color print engine 100 will be inactive.

The hybrid printing system 10, 20, 30 thus includes (a) a machine frame 12; (b) a full color print engine or multi-color image producing module 100 mounted within the machine frame and including color image output terminals 110, 120, 130, 140 and an endless intermediate transfer member or belt 150 for receiving color images from the color image output terminals to form a multi-color image M1; (c) a separate black print engine or black image producing module 200 mounted within the machine frame 12, spaced from the multi-color image producing module 100 (as shown) and including a black image output terminal 210; and (d) a print media transport/transfer module 50 mounted within the machine frame for receiving and moving image receiving print media 62 through the machine frame. The print media transport/transfer module 50 includes a repositionable electrostatic transport/transfer member or belt assembly 51 having multi-positions including (i) a first position forming a first image transfer nip 56 (FIGS. 2 and 4) with the endless intermediate transfer member or belt 150 of the multi-color image producing module 100, and (ii) a second position forming a second image transfer nip 58 (FIGS. 3 and 5) with the black image output terminal 210.

The color image output terminals include at least Cyan, Magenta and Yellow color image output terminals 120, 130, 140 (FIGS. 1-6) and alternatively can also include an included black color image output terminal 110 (FIGS. 1-5). The endless intermediate transfer member is a transfer belt 152; and the repositionable electrostatic transport/transfer member 50 includes an endless transport/transfer belt 57.

The hybrid printing system 10, 20, 30 as disclosed is independent of whether the multi-color image producing module 100 and/or the black image producing module is xerographic or non-xerographic such as ink jet or solid ink. In one embodiment, the hybrid printing system is xerographic, and the black image output terminal 210 of the black image producing module 200 is thus a xerographic module and includes a drum photoreceptor 212.

As illustrated, the hybrid printing system 10, 20, 30 includes a first moving means 14 for moving the first bias roll 52 of the repositionable electrostatic transport/transfer module 50 into and out of the first image transfer nip 56 with the intermediate transfer member or belt 150 of the full color image producing module 100, and a second moving means 16 for moving the second bias roll 54 of the repositionable electrostatic transport/transfer module 50 into and out of the second image transfer nip 58 with the black image output terminal 210.

The controller 40 is suitable for controlling on and off operation of the multi-color image producing module 100, of the black image producing module 200, and for controlling movement and positioning of the repositionable electrostatic transport/transfer member or module 50. Further, in the xerographic embodiment, the hybrid printing system 10, 20, 30 includes the fusing apparatus or module 80 located inline with the print media transport/transfer module 50 for receiving and fusing images on print media 62 moved through the machine frame.

As described above, on the one hand when the first moving means 14 has moved the transport/transfer member 50 into the transfer position of the first image transfer nip 56 with intermediate transfer member or belt 150 of the multi-color image producing module 100, the second moving means 16 will be out of the second image transfer nip 58 with the black image output terminal 210. On the other hand when the first moving means 14 has moved the transport/transfer member 50 out of the transfer position of the first image transfer nip 56 with intermediate transfer member or belt 150 of the multi-color image producing module 100, the second moving means 16 will be into the transfer position in the second image transfer nip 58 with the black image output terminal 210. As illustrated, the first moving means 14 includes the first biased electrostatic transfer backup roll 52 for assisting a xerographic image transfer from the intermediate transfer member or belt 150 onto a print media 62 within the first image transfer nip 56. Similarly, the second moving means 16 includes the second biased electrostatic transfer backup roll 54 for assisting a xerographic image transfer from the black image output terminal 210 onto a print media 62 within the second image transfer nip 58.

The controller 40 includes a multi-color mode control 42 for operating the hybrid printing system 10, 20, 30 as a multi-color machine (FIGS. 3 and 5) during which the black image producing module is turned off, the first moving means 14 is moved into the first transfer nip 56 forming relationship with the intermediate transfer member or belt 150, and the second moving means 16 is moved out of the second nip 58 forming relationship with the black image output terminal 210. The multi-color mode control 42 also includes a first throughput speed V1 that is relatively less than a second speed V2 for operating the hybrid printing system 10, 20, 30 is in a black mode control.

The controller 40 also includes a black mode control 44 for operating the hybrid printing system 10, 20, 30 as a stand-alone black machine during which the multi-color image producing module 100 is turned off, the first moving means 14 is moved out of the first nip 56 forming relationship with the intermediate transfer member or belt 150, and the second moving means 16 is moved into the second nip 58 forming relationship with the black image output terminal 210.

The difference between the first embodiments of FIGS. 2 and 3 from those of FIGS. 3 and 4 as shown, is that the electrostatic transport/transfer module in FIGS. 4 and 5 is relatively longer, thus allowing for a different arrangement of the color and black imaging modules 100, 200.

An alternate lower cost second embodiment 30 of the hybrid printing system is shown in FIG. 6. As illustrated, the multi-color image producing module 100' comprises no included black image output terminal, and thus only comprises the Cyan, Magenta and Yellow image output terminals 120, 130 and 140. Instead, the separate black image producing module 200, besides being selectably operated alone to produce black only images as above, is also coupled with the multi-color image producing module 100', therewith controlled to produce multi-color images when needed. It is recognized that color image registration will not be as good in this embodiment 30 as it is in the first embodiments 10, 20. Some other trade offs will be necessary too, however, the color images produced thus will be acceptable for a lot of applications.

As can be seen, there has been provided a hybrid printing system including (a) a machine frame; (b) a multi-color image producing module mounted within the machine frame and including color image output terminals and an endless intermediate transfer member for receiving color images from the color image output terminals to form a multi-color image; (c) a separate black image producing module mounted within the machine frame spaced from the multi-color image producing module and including a black image output terminal; and (d) a print media transport/transfer module mounted within the machine frame for receiving and moving image receiving print media through the machine frame, the print media transport/transfer module including a repositionable electrostatic transport/transfer member having multi-positions including (i) a first position forming a first image transfer nip with the endless intermediate transfer member, and (ii) a second position forming a second image transfer nip with the black image output terminal.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

What is claimed is:

1. A hybrid printing system comprising:

(a) a machine frame;

(b) a multi-color image producing module mounted within the machine frame and including color image output terminals and an endless intermediate transfer member for receiving color images from the color image output terminals forming a multi-color image;

(c) a separate black image producing module mounted within the machine frame spaced from the multi-color image producing module and including a black image output terminal;

(d) a print media transport/transfer module mounted within the machine frame for receiving and moving image receiving print media through the machine frame, the print media transport/transfer module including a repositionable electrostatic transport/transfer member having multi-positions including (i) a first position forming a first image transfer nip with the endless intermediate transfer member and (ii) a second position forming a second image transfer nip with the black image output terminal; and (e) a first moving means for moving the repositionable electrostatic transport/transfer member into and out of the first image transfer nip with the intermediate transfer member, and a second moving means for moving the repositionable electrostatic transport/transfer member into and out of a second image transfer nip with the black image output terminal.

2. The hybrid printing system of claim 1, wherein the color image output terminals include at least Cyan, Magenta and Yellow color image output terminals.

3. The hybrid printing system of claim 1, wherein the color image output terminals include Cyan, Magenta Yellow and another Black, color image output terminals.

4. The hybrid printing system of claim 1, wherein the endless intermediate transfer member is a belt.

5. The hybrid printing system of claim 1, wherein the repositionable electrostatic transport/transfer member includes an endless transport/transfer belt.

6. The hybrid printing system of claim 1, wherein the black image output terminal of the black image producing module is a xerographic module and includes a drum photoreceptor.

7. The hybrid printing system of claim 1, including a controller for controlling on and off operation of the multi-color image producing module, the black image producing module and positioning of the repositionable electrostatic transport/transfer member, and a multi-color mode control for operating the hybrid printing system as a multi-color machine, the multi-color mode control including turning the black image producing module off, moving the first moving means into the first nip forming relationship with the intermediate transfer member, and moving the second moving means out of the second nip forming relationship with the black image output terminal.

8. The hybrid printing system of claim 1, including a fusing apparatus located inline with the print media transport/transfer module for receiving and fusing images on print media moved through the machine frame.

9. The hybrid printing system of claim 1, wherein when the first moving means is into the first image transfer nip with the intermediate transfer member, the second moving means is out of the second image transfer nip with the black image output terminal.

10. The hybrid printing system of claim 1, wherein when the first moving means is out of the first image transfer nip with the intermediate transfer member, the second moving means is into the second image transfer nip with the black image output terminal.

11. The hybrid printing system of claim 1, wherein the first moving means includes a first biased electrostatic transfer backup roll for assisting a xerographic image transfer from the intermediate transfer member onto a print media within the first image transfer nip.

12. The hybrid printing system of claim 1, wherein the second moving means includes a second biased electrostatic transfer backup roll for assisting a xerographic image transfer from the black image output terminal onto a print media within the second image transfer nip.

13. The hybrid printing system of claim 7, including a black mode control for operating the hybrid printing system as a stand-alone black machine, the black mode control including turning the multi-color image producing module off, moving the first moving means out of the first nip forming relationship with the intermediate transfer member, and moving the second moving means into the second nip forming relationship with the black image output terminal.

14. The hybrid printing system of claim 7, wherein the multi-color mode control includes a first throughput speed that is relatively less than a second speed for operating the hybrid printing system in a black mode control comprising turning the multi-color image producing module off, moving the first moving means out of the first nip forming relationship with the intermediate transfer member, and moving the second moving means into the second nip forming relationship with the black image output terminal.

15. The hybrid printing system of claim 7, wherein the color image output terminals include Cyan, Magenta and Yellow color image output terminals and the controller includes a multi-color mode control for operating the hybrid printing system as a multi-color machine, the multi-color mode control including moving the first moving means into the first nip forming relationship with the intermediate transfer member, and moving the second moving means into the second nip forming relationship with the black image output terminal.

16. The hybrid printing system of claim 7, wherein the black mode control includes a second throughput speed that is relatively greater than a first speed for operating the hybrid printing system in a multi-color mode control comprising turning the black image producing module off, moving the first moving means into the first nip forming relationship with the intermediate transfer member, and moving the second moving means out of the second nip forming relationship with the black image output terminal.

17. The hybrid printing system of claim 7, including a media holding and supply module coupled to the print media transport/transfer module.

18. The hybrid printing system of claim 17, wherein the media holding supply module includes cut sheet media.

* * * * *